US006918777B2

(12) United States Patent
Fan

(10) Patent No.: US 6,918,777 B2
(45) Date of Patent: Jul. 19, 2005

(54) ELECTRICAL CONNECTOR

(75) Inventor: Chia Hao Fan, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/977,162

(22) Filed: Oct. 28, 2004

(65) Prior Publication Data

US 2005/0095881 A1 May 5, 2005

Related U.S. Application Data

(63) Continuation-in-part of application No. 29/199,414, filed on Feb. 13, 2004, now Pat. No. Des. 500,740.

(30) Foreign Application Priority Data

Oct. 31, 2003 (TW) ..... 92219419 U

(51) Int. Cl.[7] ..... H01R 13/44
(52) U.S. Cl. ..... 439/135; 439/607; 439/940
(58) Field of Search ..... 439/74, 135, 607, 439/660, 940

(56) References Cited

U.S. PATENT DOCUMENTS

| | | | | |
|---|---|---|---|---|
| 5,688,133 A | * | 11/1997 | Ikesugi et al. | 439/135 |
| 5,899,760 A | * | 5/1999 | Ho et al. | 439/135 |
| 6,116,949 A | * | 9/2000 | Costello et al. | 439/509 |
| 6,371,776 B1 | * | 4/2002 | Li et al. | 439/135 |
| 6,749,463 B1 | * | 6/2004 | Fan | 439/607 |
| 6,796,839 B1 | * | 9/2004 | Wu | 439/607 |

* cited by examiner

*Primary Examiner*—Thanh-Tam Le
(74) *Attorney, Agent, or Firm*—Wei Te Chung

(57) ABSTRACT

An electrical connector (1) adapted for mounting on a printed circuit board includes an insulative housing (10) and a number of first and second terminals (30, 31) received in the insulative housing. The insulative housing includes a mounting face (15) defined in a bottom thereof, and a mating face (124) defined on a top thereof and inclined by a specified angle from the mounting face. During mounting process, a pick-up cap (40) is assembled to the insulative housing, which includes a body portion (41) and first and second arms (42, 43) extending toward the mounting face of the insulative housing at different distances. The electrical connector is mounted on the printed circuit board accurately by suctioning the pick-up cap.

4 Claims, 6 Drawing Sheets

ELECTRICAL CONNECTOR

This appl. is a Continuation-in-part (CIP) of prior application Ser. No. 29/199,414, filed Feb. 13, 2004, now U.S. Pat. No. Des. 500,740.

BACKGROUND OF THE INVENTION

1. Field of the Invention

The present invention generally relates to an electrical connector, and more particularly to an electrical connector with a mounting face having a specified inclined angle. The invention relates to the copending applications titled "SHIELD BOARD-MOUNTTED ELECTRICAL CONNECTOR" and "ELECTRICAL CONNECTOR HAVING IMPROVED ELECTROSTATIC DISCHARGE PROTECTION" having the same applicant and the same assignee with the instant invention.

2. Description of Prior Art

With a miniaturization development of notebook computers, a docking station is employed to increase the number of functional devices connected with a notebook computer or to interconnect a notebook computer with peripheral devices. The docking station typically provides a high density connector functioning as an exterior interface to connect with a complementary connector mounted on the notebook computer, thereby establishing an electrical connection between the notebook computer and the docking station. Generally, the high density connector is right-angled and mates with the complementary connector in a direction perpendicular to a printed circuit board (PCB), onto which the high density connector is mounted.

The electrical connector is manufactured by first bending terminals, then insert-molding terminals in a housing, and finally being placed onto a circuit board for soldering. However, depending on the condition in which the electrical connector applied, there may be cases in which it is necessary to deflect the connector to a specified angle with respect to the PCB before soldering process. So the mating direction of the electrical connector is inclined with respect to the PCB. But this deflection will inevitably influence the coplanarity of the terminals, further effect soldering quality between the electrical connector and the circuit board.

Hence, an electrical connector having a specified inclined angle is required to overcome the disadvantages of the prior art.

SUMMARY OF THE INVENTION

An object of the present invention is to provide an electrical connector having a mounting face with a specified inclined angle.

Another object of the present invention is to provide an electrical connector assembly having a pick-up cap for facilitating automatic assembling thereof.

In order to achieve the objects set forth, an electrical connector assembly in accordance with the present invention comprises an electrical connector and a pick-up cap detachably mounted on the electrical connector. The electrical connector comprises an insulative housing, a plurality of first and second terminals and a shield. The insulative housing comprises a mounting face defined in a bottom thereof, a mating face defined on a top thereof and inclined by a specified angle from the mounting face, a pair of sidewalls extending between the mounting face and the mating face, and a pair of end walls connected with the sidewalls. The sidewalls and the end walls together form an insertion space. A tongue board extends upwardly in the insertion space and is perpendicular to the mating face. Each terminal comprises a contacting portion and a tail portion extending out of the bottom of the insulative housing. The contacting portions are arrayed on opposite sides of the tongue board and the tail portions are arrayed on a plane parallel to the mounting face. The shield covers the insulative housing. The pick-up is mounted on the top of the insulative housing and comprises a body portion and a first, second arm bent extending downwardly from opposite edges of the body portion. The first and second arms extend toward the mounting face of the insulative housing at different distances.

Other objects, advantages and novel features of the invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 5:
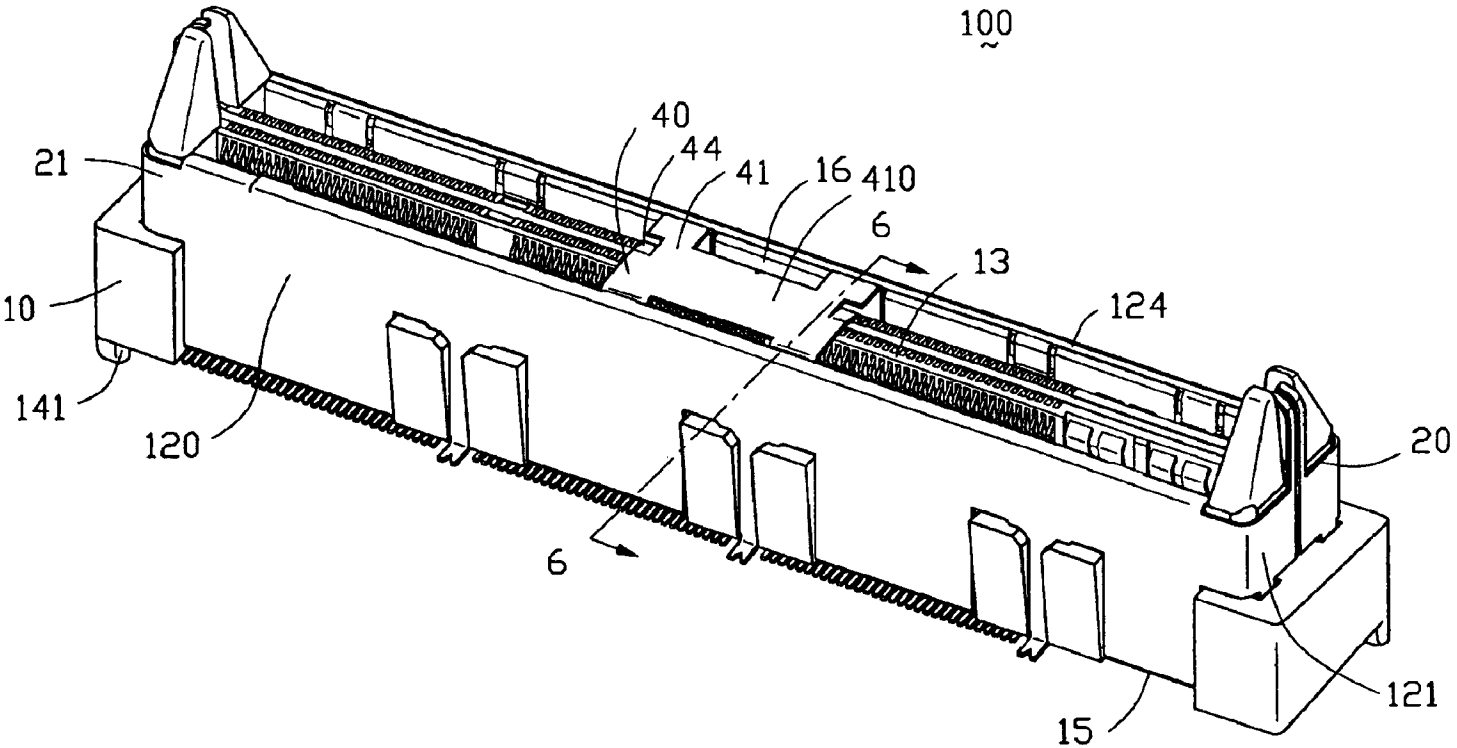
FIG. 5 is a perspective view of the electrical connector assembly.

Referring to FIG. 5, an electrical connector assembly 100 in accordance with the present invention comprises an electrical connector 1 and a pick-up cap 40 detachably mounted on a top of the electrical connector 1 for facilitating automatic assembling.

Figure 1:
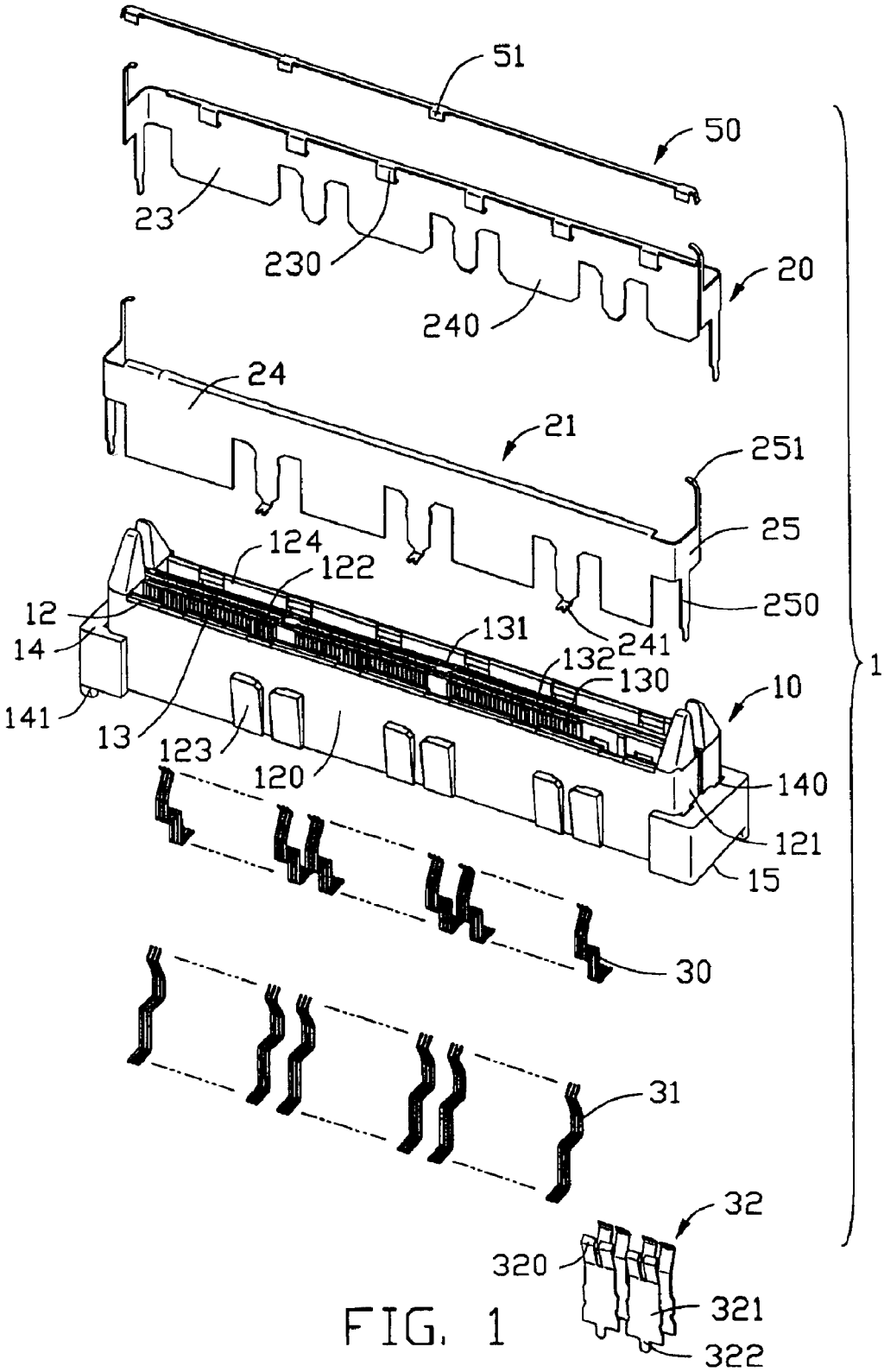
FIG. 1 is an exploded perspective view of an electrical connector of an electrical connector assembly in accordance with the present invention.
Figure 2:
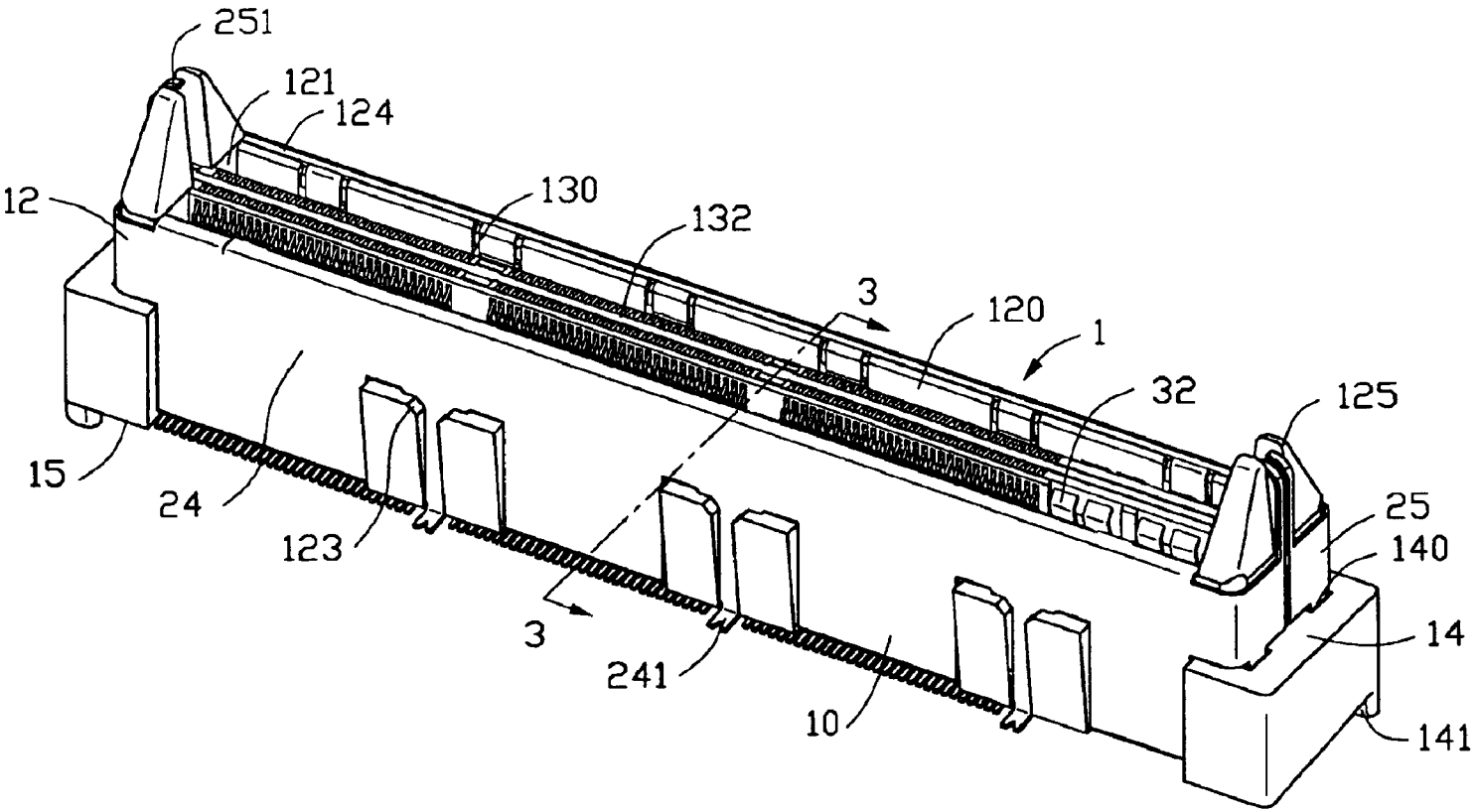
FIG. 2 is an assembled perspective view of FIG. 1.
Figure 3:
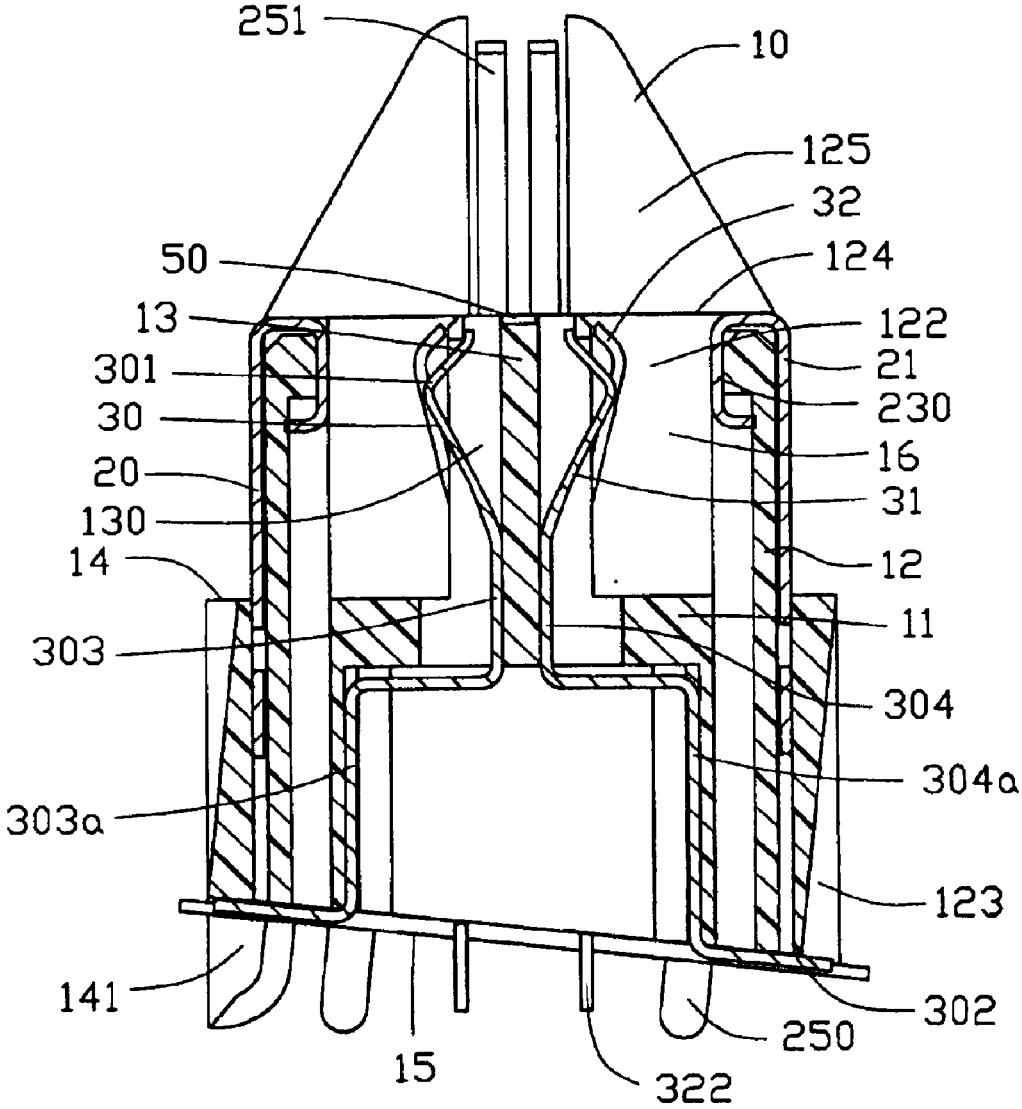
FIG. 3 is a cross-section view of FIG. 2 taken along line 3—3.

Referring to FIGS. 1–3, the electrical connector 1 mounted onto a printed circuit board (PCB) (not shown) comprises an insulative housing 10, a first and second shells 20, 21 assembled on the insulative housing 10, a plurality of first and second terminals 30, 31 received in the insulative housing 10 and an electro-static discharge (ESD) pole 50 mounted on a top of the insulative housing 10.

The insulative housing 10 of the electrical connector 1 comprises a mounting face 15 defined on a bottom face thereof and parallel to the PCB, a longitudinal base 11 located above the mounting face 15, a mating portion 12 extending upwardly from the base 11 and a pair of end portions 14 formed at opposite longitudinal ends of the base 11. The mating portion 12 comprises a pair of parallel long sidewalls 120, and a pair of end walls 121 connecting with the sidewalls 120. The sidewalls 120 and the end walls 121 together form an insertion space 16 for receiving an inserting portion of a complementary connector (not shown). A mating face 124 is defined on a top face of the sidewalls 120 and the end walls 121 and inclines by a specified angle from the mounting face 15. A plurality of spaced notches 122 is defined on opposite inner walls of the sidewalls 120 extending downwardly from the mating face 124 toward the mounting face 15. A plurality of spaced blocks 123 is disposed on a lower portion of the sidewall 120 with a slit (not labeled) formed therebetween. A tongue board 13 projects upwardly from the base 11 into the insertion space 16. A plurality of passages 130 is formed in opposite sides of the tongue board 13. A slot 132 extends longitudinally on a top face of the tongue board 13 with a plurality of spaced recesses 131 formed at opposite sides thereof. A pair of guiding posts 125 extends upwardly from opposite end walls 121 respectively. Each end portion 14 has a groove 140 extending downwardly therethrough and a locating post 141 protruding downwardly from a bottom thereof.

The first shell 20 has a flat first body 23 covering the sidewall 120 of the insulative housing 10. A plurality of spaced engaging portions 240 is formed in a lower portion of the first body 23. The engaging portions 240 are received in corresponding slits, which are formed by the adjacent blocks 123 of the insulative housing 10. A plurality of grounding tabs 241 extends from distal ends of the engaging portions 240 away from the sidewall 120 of the insulative housing 10. A plurality of spaced latches 230 extends inwardly and downwardly from a top of the first body 23 for engaging with corresponding notches 122 of the insulative housing 10. A pair of opposite wings 25 extends laterally from opposite ends of the first body 23 for enclosing the end walls 121 of the insulative housing 10. A pair of free tips 251 extends upwardly from the wings 25 sandwiched by the guiding post 125. A grounding tail 250 projects downwardly from wing 25 through the groove 140 of the end portion 14 to connect with a grounding trace on the PCB. The second shell 21 is similar to the first shell 20 in structure. The second shell 21 has a flat second body 24 assembled to the sidewall 120 of the insulative housing 10. The first body 23 and the second body 24 have different height with respect to the mounting face 15 of the insulative housing 10.

The ESD pole 50 has a plurality of retaining tabs 51 formed thereon. When the ESD pole 50 is assembled to the insulative housing 10, the retaining tabs 51 are received in corresponding recesses 131 of the insulative housing 10. The shells 20, 21 and the ESD pole 50 together define a closed loop to provide Electro Magnetic Interference (EMI) protection for the electrical connector 1.

The first and second terminals 30, 31 are used for transmitting signals to the complementary connector and received in corresponding passages 131 of the insulative housing 10. Each terminal 30, 31 comprises a tail portion 302 extending out of the bottom face of the insulative housing 10 along a direction parallel to the mounting face 15, a contacting portion 301 for engaging with a contact portion of the complementary connector. The first terminal 30 comprises a first connecting portion 303 connecting the tail portion 302 and the contacting portion 301. The second terminal 31 comprises a second connecting portion 304, which is similar to the first connecting portion 303 in structure. Each connecting portion 303, 304 comprises an upper portion (not labeled) and a lower portion 303*a*, 304*a* extending downwardly from a corresponding upper portion. The lower portion 303*a* of the first terminal 30 and the tail portion 302 together form an acute angle, while the lower portion of the second terminal 31 and the tail portion 302 together form an obtuse angle. The lower portion 303*a* and the lower portion 304*a* extend toward the mounting face 15 of the insulative housing 10 at different distances.

A plurality of power terminals 32 are received in the insulative housing 10. Each power terminal 32 comprises a securing portion 321 retained in the insulative housing 10, a contacting portion 320 extending upwardly from the securing portion 321 and a soldering portion 322 extending downwardly from the securing portion 321 for connecting to the PCB.

Figure 4:
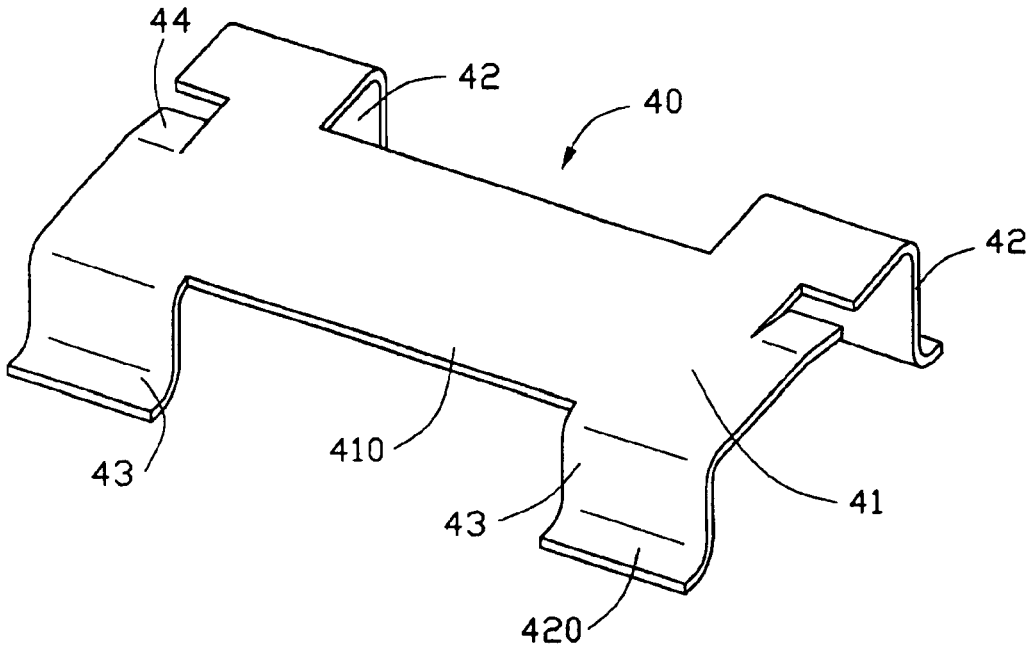
FIG. 4 is a perspective view of a pick-up cap used in the electrical connector of FIG. 2.
Figure 6:
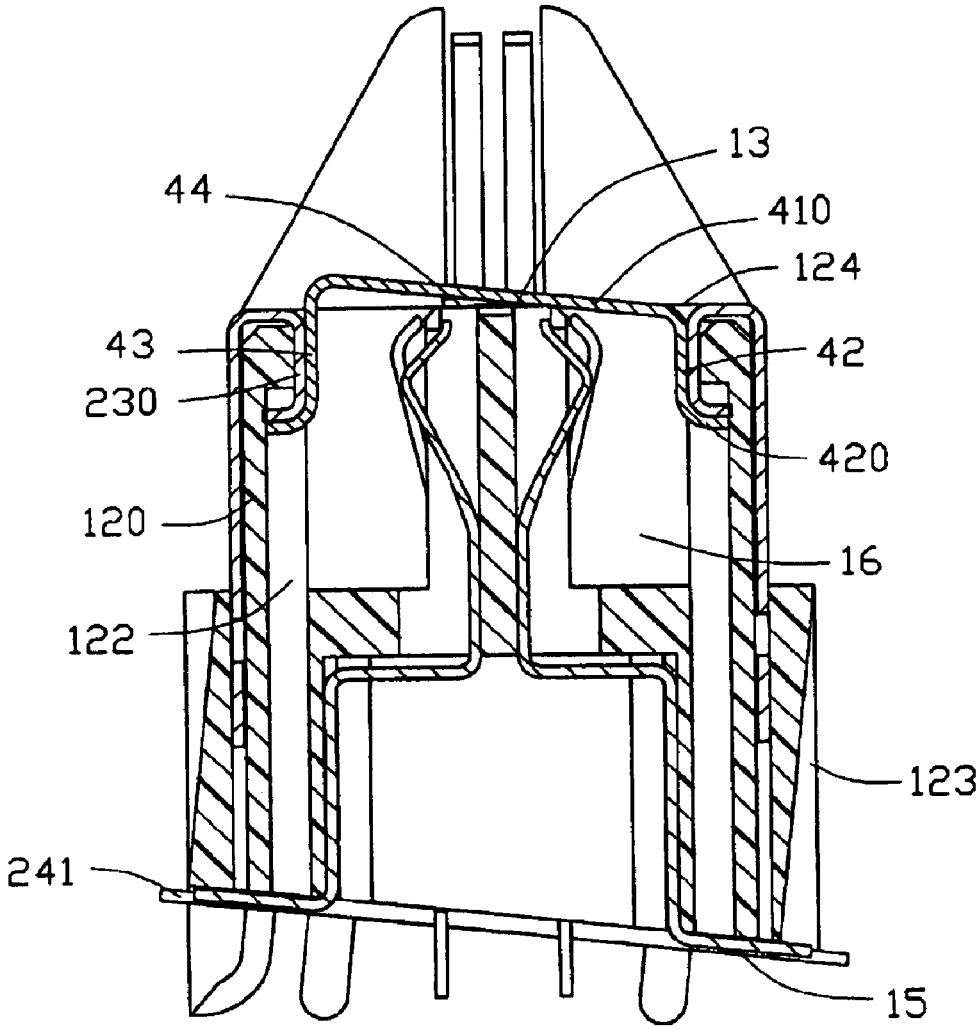
FIG. 6 is a cross-section view of FIG. 5 taken along line 6—6.

Referring to FIGS. 4–6, the pick-up cap 40 is mounted on the insulative housing 10 of the electrical connector 1. The pick-up cap 40 comprises a body portion 41, a pair of elastic first arms 42 bent and extending downwardly from one side edge of the body portion 41, a pair of elastic second arms 43 extending downwardly from the other side edge of the body portion 41, and a pair of opposite contact tabs 44 formed at opposite ends of the body portion 41. The body portion 41 is generally rectangular and provides a flat suction face 410 for being sucked by a vacuum suction nozzle. Each first/second arm 42/43 has a latching portion 420 at a distal end thereof. The first arms 42 and the second arms 43 having different extending lengths in a direction toward the mounting face 15 of the insulative housing 10.

When the pick-up cap 40 is assembled to the electrical connector 1, the contact tabs 44 abut against a top face of the tongue board 13 by pressing the body portion 41. The suction face 410 of the body portion 41 is parallel to the mounting face 15 of the insulative hosing 10. The first arm 42 and the second arm 43 are inserted into the insertion space 16 of the insulative housing 10 with the latching portions 420 engaging with corresponding latches 230 of the shell 20,21. So the pick-up cap 40 is securely mounted on the insulative housing 10 for facilitating automatic assembling of the electrical connector 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprises:

an electrical connector for mounting on a printed circuit board (PCB), comprising:

an insulative housing defining a mounting face in a bottom thereof and parallel to the PCB, a mating face in a top thereof and inclined by a specified angle from the mounting face, an insertion space defined between the mating face and the mounting face thereof, and a tongue board extending in the insertion space;

a plurality of terminals received in the insulative housing; and an electro-static discharge pole assembled on the top of the insulative housing; and a pick-up cap detachably mounting on the electrical connector, comprising:

a body portion;

a pair of first arms oppositely extending downwardly from one side edge of the body portion; and a pair of second arms oppositely extending downwardly from other side edge of the body portion;

wherein the first and second pair of arms extending different lengths in a direction toward the mounting face of the insulative housing;

wherein each of the first and second pair of arms has a latching portion at a distal end thereof;

wherein the electrical connector comprises a first shell and a second shell covering the insulative housing;

wherein a plurality of latches is disposed at a top portion of the first and the second shells for being latched to the insulative housing; and wherein the first and the second pair of arms are inserted into the insertion space of the insulative housing, with the latching portions thereof engaging with corresponding latches of the first and second shells.

2. The electrical connector assembly as claimed in claim 1, wherein the body portion of the pick-up cap has a flat suction face for being sucked by a vacuum suction nozzle.

3. The electrical connector assembly as claimed in claim 2, wherein the body portion of the pick-up cap has a pair of contact tabs at opposite ends thereof, and the contact tabs abut against a top of the insulative housing.

4. The electrical connector assembly as claimed in claim 1, wherein the electro-static discharge pole has a plurality of retaining tabs, and wherein a plurality of recesses is disposed in the insulative housing for receiving the retaining tabs.

* * * * *